United States Patent [19]

Bartel et al.

[11] 4,119,345

[45] Oct. 10, 1978

[54] IN SITU OIL SHALE RETORTING PROCESS USING INTRODUCTION OF GAS AT AN INTERMEDIATE LOCATION

[75] Inventors: William J. Bartel; Robert S. Burton, III, both of Grand Junction, Colo.; Chang Yul Cha, Bakersfield, Calif.

[73] Assignee: Occidental Oil Shale, Inc., Grand Junction, Colo.

[21] Appl. No.: 784,033

[22] Filed: Apr. 4, 1977

Related U.S. Application Data

[63] Continuation-in-part of Ser. No. 737,154, Oct. 29, 1976, abandoned, which is a continuation of Ser. No. 683,037, May 4, 1976, abandoned, which is a continuation of Ser. No. 615,043, Sep. 19, 1975, abandoned, which is a continuation of Ser. No. 492,768, Jul. 29, 1974, abandoned.

[51] Int. Cl.[2] ..... E21B 43/24; E21B 43/26; E21C 41/10

[52] U.S. Cl. ..... 299/2; 166/251; 166/259

[58] Field of Search ..... 166/251, 256, 259, 260, 166/261, 262; 299/2

[56] References Cited

U.S. PATENT DOCUMENTS

| | | | |
|---|---|---|---|
| 2,481,051 | 9/1949 | Uren | 166/302 X |
| 2,801,089 | 7/1957 | Scott, Jr. | 166/260 X |
| 2,946,382 | 7/1960 | Tek et al. | 166/259 |
| 2,970,826 | 2/1961 | Woodruff | 166/256 X |
| 3,138,203 | 6/1964 | Weiss et al. | 166/251 |
| 3,228,468 | 1/1966 | Nichols | 166/259 |
| 3,490,529 | 1/1970 | Parker | 166/256 |
| 3,499,489 | 3/1970 | Parker | 166/272 X |
| 3,601,193 | 8/1971 | Grady | 166/259 X |
| 3,620,301 | 11/1971 | Nichols | 166/251 |
| 3,661,423 | 5/1972 | Garret | 299/2 |
| 3,692,110 | 9/1972 | Grady | 166/259 X |

*Primary Examiner*—Stephen J. Novosad
*Assistant Examiner*—George A. Suchfield
*Attorney, Agent, or Firm*—Christie, Parker & Hale

[57] ABSTRACT

Values are recovered from a subterranean in situ oil shale retort containing a fragmented permeable mass of formation particles by passing a measuring gas through the retort to determine the presence of a blockage in the fragmented mass. If there is such a blockage, only a portion of the fragmented mass is processed and the portion of the fragmented mass having the blockage is left unprocessed. This is effected by introducing a processing gas to the retort at an intermediate location between opposing ends of the fragmented mass and withdrawing gaseous and liquid products of processing at an end of the fragmented mass remote from such blockage.

16 Claims, 1 Drawing Figure

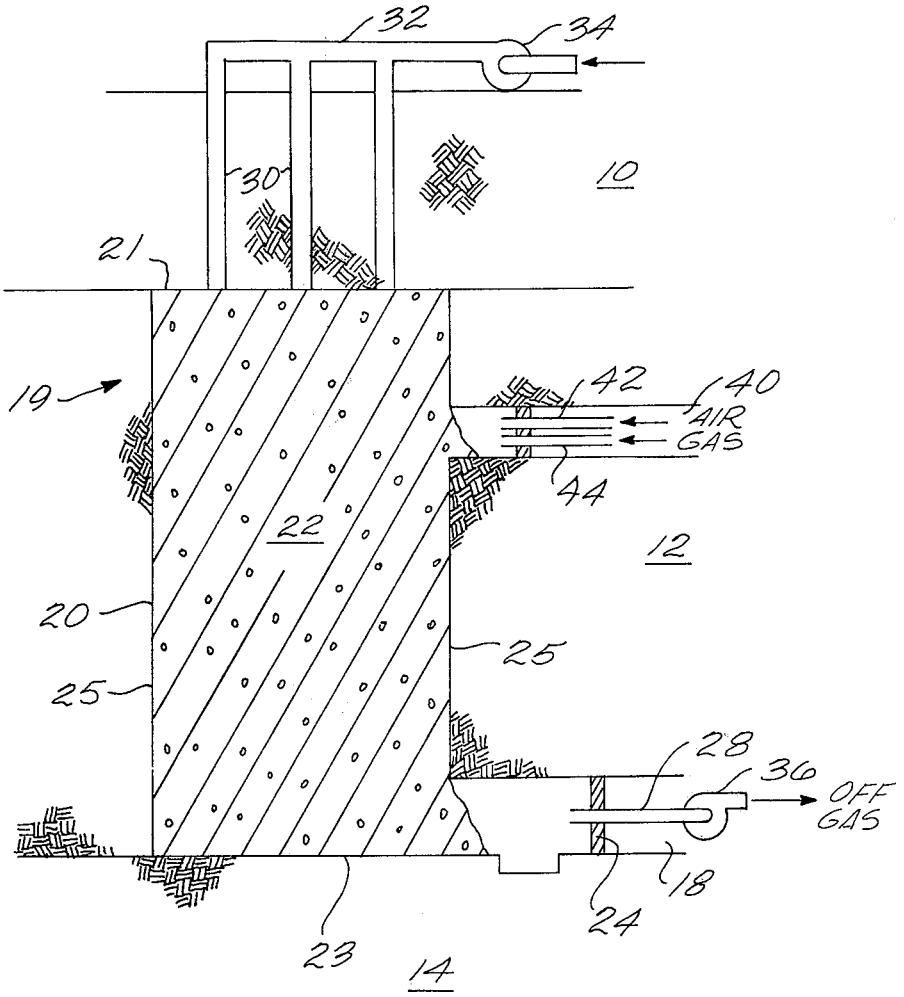
32
34
30
10
21
19
42
40
AIR
GAS
44
22
12
20
25
25
28
36
OFF
GAS
18
24
23
14

IN SITU OIL SHALE RETORTING PROCESS USING INTRODUCTION OF GAS AT AN INTERMEDIATE LOCATION

CROSS-REFERENCES

This application is a continuation-in-part of copending application Ser. No. 737,154 filed on Oct. 29, 1976, now abandoned, the subject matter of which is incorporated herein by reference and which is a continuation of patent application Ser. No. 683,037 filed on May 4, 1976, now abandoned, which is a continuation of patent application Ser. No. 615,043, filed on Sept. 19, 1975, now abandoned, which is a continuation of application Ser. No. 492,768 filed on July 29, 1974, now abandoned.

BACKGROUND OF THE INVENTION

The presence of large deposits of oil shale in the Rocky Mountain region of the United States has given rise to extensive efforts to develop methods of recovering shale oil from kerogen in the oil shale formations. It should be noted that the term "oil shale" as used in the industry is in fact a misnomer; it is neither shale nor does it contain oil. It is a sedimentary formation comprising marlstone deposit interspersed with layers containing an organic polymer called "kerogen", which upon heating, decomposes to produce liquid and gaseous products. It is the formation containing kerogen that is called "oil shale" herein, and the carbonaceous liquid product is called "shale oil". A number of methods have been developed for processing the oil shale which involve either first mining the kerogen bearing shale and processing the shale on the surface, or processing the shale in situ. The latter approach is preferable from the standpoint of environmental impact since the spent shale remains in place, reducing the chance of surface contamination and the requirement of disposal of solid wastes.

The recovery of liquid and gaseous products from oil shale deposits has been described in several patents, one of which is U.S. Pat. No. 3,661,423, issued May 9, 1972, to Donald E. Garrett, assigned to the assignee of this application and incorporated herein by reference. This patent describes in situ recovery of liquid and gaseous carbonaceous materials from a subterranean formation containing oil shale by mining a chamber in the formation, and explosively fragmenting and expanding formation around the chamber to form a cavity containing a stationary, fragmented, permeable mass of formation particles containing oil shale within the formation, referred to herein as an in situ oil shale retort.

Once the retort is thus formed in situ, the fragmented mass of formation particles is ignited at the top of the retort to establish a combustion zone in the retort. A combustion supporting processing gas comprising oxygen, such as air, is introduced into the combustion zone to sustain combustion of oil shale in the combustion zone and to advance the combustion zone through the retort. In the combustion zone oxygen in the combustion supporting processing gas is depleted by reaction with hot carbonaceous materials to produce heat, combusted oil shale, and combustion gas. By the continued introduction of the combustion supporting gas into the combustion zone, the combustion zone is advanced through the retort. An effluent gas from the combustion zone, comprising combustion gas and the portion of the combustion supporting gas that does not take part in the combustion process, passes through the retort on the advancing side of the combustion zone to produce retorted oil shale and to heat the oil shale in a retorting zone to a temperature sufficient to produce kerogen decomposition, called retorting, to gaseous and liquid hydrocarbon products.

As used herein, the term "retorted oil shale" refers to oil shale heated to a sufficient temperature to decompose kerogen in an environment substantially free of free oxygen so as to leave a solid carbonaceous residue. The term "combusted oil shale" refers to oil shale of reduced carbon content due to oxidation by a gas containing free oxygen. An individual particle containing oil shale can have a core of retorted oil shale and an outer "shell" of combusted oil shale. Such can occur when oxygen has diffused only part way through the particle during the time it is at an elevated temperature and in contact with an oxygen supplying gas.

As used herein, the term "processing gas" is used to indicate gas which serves to advance a processing zone such as a combustion zone, a retorting zone, or both a retorting zone and combustion zone, through an in situ oil shale retort. The term "processing gas" includes, but is not limited to, an oxygen supplying gas introduced into a retort for advancing a combustion zone and retorting zone through a retort, and a hot retorting gas which can be introduced into a retort or generated in a combustion zone in a retort for advancing a retorting zone through a retort.

The liquid hydrocarbon products and gaseous hydrocarbon products are cooled by the cooler oil shale particles in the retort on the advancing side of the retorting zone. The liquid products are collected at the bottom of the retort and withdrawn to the surface. An off gas containing combustion gas generated in the combustion zone, product gas produced in the retorting zone, and the portion of the combustion supporting gas that does not take part in the combustion process is also collected at the bottom of the retort and withdrawn to the surface.

The overall efficiency of the retorting operation is affected by the effectiveness of the explosive expansion of the formation to form a fragmented permeable mass. If the formation is not sufficiently fragmented, the total surface area of the particles in the fragmented mass is reduced and thus the rate at which the core portion of larger particles of the fragmented mass is heated to produce kerogen decomposition is reduced. In addition, unsatisfactory fragmentation can adversely affect resistance to gas flow through the fragmented mass. For economical retorting, it is desirable that gas passing through the retort have a unit pressure drop of less than about 0.01 or 0.02 psi. As used herein, the term "unit pressure drop" refers to the pressure drop or pressure gradient of gas passing through a fragmented permeable mass of formation particles containing oil shale at 1 standard cubic foot per minute per square foot of cross sectional area of the fragmented permeable mass per foot of advancement of the gas through the fragmented mass. Thus, for example, a retort with a length of 200 feet and unit pressure drop of 0.01 psi has a total pressure drop of 2 pounds per square inch when the flow rate of gas is one SCFM per square foot of cross sectional area of the fragmented mass. Above a unit pressure drop of about 0.02 psi, an undesirable amount of power is required to drive the gas blowers causing retorting gas to flow through the retort, particularly when long retorts such as retorts of 1,000 feet in height are being retorted.

After an in situ oil shale retort is formed, tests are made to determine the pressure drop through the fragmented permeable mass in the retort. If inadequate flow rate at a selected pressure gradient is obtained, one could either operate the retort as reduced efficiency, abandon the retort, or attempt to further fragment the mass of particles into smaller sizes to clear the blockage of gas flow.

SUMMARY OF THE INVENTION

The present invention is directed toward an improved method for recovering values from an in situ oil shale retort in a subterranean formation containing oil shale, the in situ retort containing a fragmented permeable mass of formation particles having side boundaries, a first end boundary, and a second end boundary. The method comprises passing a measuring gas through the fragmented mass between the first and second end boundaries of the fragmented mass. The unit pressure drop of the measuring gas is measured in a first portion of the fragmented mass between the first end boundary and an intermediate location between the first end boundary and the second end boundary of the fragmented mass. The unit pressure drop is also measured in a second portion of the fragmented mass between the intermediate location and the second end boundary. This is done to determine if the unit pressure drop of the measuring gas is substantially greater in the first portion than in the second portion of the fragmented mass.

If the unit pressure drop of the measuring gas is substantially greater in the first portion than in the second portion of the fragmented mass, a processing gas is introduced to the retort at an intermediate location between the first portion of the fragmented mass and the second end boundary of the fragmented mass for processing oil shale in the retort in the second portion of the fragmented mass. This leaves unprocessed oil shale in the first portion of the fragmented mass. The first end boundary of the fragmented mass can be the top of the retort and the second end boundary of the fragmented mass can be the bottom of the retort. Alternatively, the first end boundary of the fragmented mass can be the bottom of the retort and the second end boundary of the fragmented mass can be the top of the retort.

DRAWING

For a more complete understanding of the invention, reference should be made to the accompanying drawing, wherein the single FIGURE is a vertical, semi-schematic, cross-sectional view of an in situ oil shale retort which is operated according to principles of the present invention.

DESCRIPTION

Referring to the drawing, there is shown a subterranean formation containing oil shale which includes an overburden 10 of rock and other material such as top soil. Below the overburden lies a formation 12 containing oil shale on top of an underlying formation 14. Such a formation 12 containing oil shale can be hundreds of feet thick and/or hundreds of feet below the ground surface.

According to the process described in the above-identified U.S. Pat. No. 3,661,426, an access drift, adit, tunnel 18, or the like is mined or otherwise provided from the surface to the bottom or lower portion of the formation 12 containing oil shale. The drift 18 can be part of a tunnel system extending to a plurality of retorts formed in a portion of the formation 12 containing oil shale.

The drift 18, which extends substantially horizontally in the subterranean formation containing oil shale, provides access to mine a void, room or chamber in the portion of formation extending above the drift. Formation adjacent the void is explosively fragmented and expanded by detonation of explosives to form an in situ oil shale retort 19 in the subterranean formation comprising a cavity 20 containing a fragmented permeable mass 22 of explosively expanded formation particles containing oil shale. The fragmented permeable mass has an upper end boundary 21, a lower end boundary 23, and side boundaries 25. When retorting thick beds of oil shale, preferably the end boundaries are spaced apart from each other a greater distance than opposing side boundaries are spaced apart from each other for efficient recovery of hydrocarbon values from the entire bed. The total volume of the void and drift 18 within the boundaries of the retort being formed is a fraction of the volume of formation to become the in situ oil shale retort, corresponding to the desired void fraction of the fragmented permeable mass of formation particles in the retort. Thus, if the retort is to contain a fragmented permeable mass of formation particles having an average void fraction of 15%, the volume of the void within the boundaries of the retort totals 15% of the formation volume to become the retort. Suitable techniques for forming an in situ oil shale retort containing a fragmented permeable mass are disclosed in U.S. patent applications Ser. Nos. 603,704, 603,705, 659,899, and 658,699, and now patent numbers 4,043,595, 4,043,596, 4,043,598, and 4,043,597, respectively.

After explosive expansion the drift 18 is blocked off at the entrance of the retort by a suitable bulkhead such as a concrete barrier 24 through which an outlet conduit such as a pipe 28 extends back through the drift 18 to the surface. The pipe 28 is used to withdraw off gas from the bottom of the retort.

Retorting of oil shale in the in situ shale retort is effected by introducing an oxygen containing gas such as air to the top of the fragmented mass through a plurality of vertical conduits or pipes 30. Air is conveyed or pumped into the pipes 30 by a suitable blower or pump 34 via a distribution pipe 32. Alternatively, or in addition, gas can be withdrawn from the bottom of the fragmented mass by a blower or pump 36 connected to the outlet pipe 28. The top of the fragmented mass of formation particles is ignited by mixing a combustible gas such as natural gas with an oxygen containing gas admitted through the vertical pipes 30 to form a flame for igniting oil shale in the mass of particles. Once the combustion zone is established, the combustible gas is discontinued and an oxygen containing, combustion supporting processing gas is introduced into the retort to sustain combustion in the combustion zone and to advance the combustion zone through the fragmented mass. The exothermic reaction of oxygen in the processing gas with carbonaceous material in the oil shale provides heat which is transferred by gas flow to heat formation particles in a retorting zone on the advancing side of the combustion zone. This heating decomposes kerogen in the oil shale and drives off liquid and gaseous hydrocarbons as products from the oil shale. Liquid products are withdrawn at the bottom of the fragmented mass. Gaseous products are withdrawn in the off gas.

The combustion supporting processing gas can be air directly from the atmosphere, air mixed with recycled off gas or other combustible or inert gas so as to have a reduced oxygen content, or air enriched with oxygen. Also, the processing gas can be substantially oxygen-free and the processing gas can be added as a hot gas to the retort for retorting the oil shale. When the processing gas is oxygen free, there is no combustion zone in the retort. A gas containing oxygen is the preferred processing gas for most in situ oil shale retorting, and the most preferred processing gas comprises air.

According to the present invention, as an initial step a measuring gas is passed from the conduit 32 into the pipes 30, downwardly through the fragmented mass in the retort and out the pipe 28. The measuring gas can be air, off gas from retorting of oil shale, or other available gas. The flow rate and pressure drop of the measuring gas are determined, and the unit pressure drop of the measuring gas is calculated. A large pressure drop with a small rate of flow of measuring gas indicates a high unit pressure drop and indicates that a blockage to gas flow exists in the fragmented mass 22. Such a blockage can be due to unsatisfactory fragmentation of formation by the blasting operation for explosive expansion of oil shade. A "blockage" is a region of high resistance to gas flow but is not necessarily a complete plug to gas flow.

Using the drilling technique described in U.S. Pat. No. 3,620,301 issued to D. T. Nichols, holes can be drilled down into the retort to different levels between the upper end boundary 21 and the lower end boundary of the fragmented mass, and pressure measurements can be made at each level. From such measurements, the vertical pressure gradient of the measuring gas through the fragmented permeable mass can be determined, and by noting the portion of the fragmented permeable mass at which the maximum unit pressure drop occurs, any blocked portion of the fragmented mass in the retort can be identified.

Other methods for identifying the presence and location of a blockage can be used.

If the blockage is in an upper portion or region of the fragmented permeable mass 20, a drift, adit, tunnel 40 or the like is mined or otherwise formed through unfragmented formation adjacent the retort at an intermediate level between the top boundary and the bottom boundary of the fragmented permeable mass. The drift 40 is in fluid communication with the fragmented mass 22 in the retort 19. If desired, a hole or holes can be drilled to the side boundary of the fragmented permeable mass at an intermediate location between the end boundaries instead of excavating a drift 40. Air and a combustible gas are introduced to the retort cavity at the intermediate level through conduits 42 and 44, respectively, which extend through the drift 40, for ignition of oil shale in the fragmented permeable mass to establish a combustion zone at the intermediate level in the fragmented permeable mass. After ignition, a combustion supporting processing gas is introduced to the retort at the intermediate level below the blockage for sustaining and advancing the combustion zone and retorting oil shale in the lower portion of the retort, thereby leaving unprocessed oil shale in the upper portion of the retort. Thus, valves are recovered from a substantial portion of the retort at high efficiency and at high gas flow rates in spite of the blockage. This is advantageous compared to either operating the retort at low efficiency or abandoning the retort after incurring the expense of mining and explosively expanding formation.

The intermediate level below the blockage at which the processing gas is introduced to the retort can be the same as or different from an intermediate level between the end boundaries of the fragmented mass at which pressure measurements are effected.

If the blockage occurs in a lower portion or region of the fragmented permeable mass, the drift 40 can be used to withdraw off gas from an intermediate level of the retort. The fragmented permeable mass in this mode of operation is ignited at the top of the fragmented permeable mass and a combustion supporting processing gas is introduced through the pipes 30 to advance the combustion zone downwardly through the fragmented permeable mass toward the intermediate level. Liquid values released by retorting oil shale can percolate down through the lower portion of the retort to be withdrawn from the bottom of the retort through the lower drift 18.

The method provided in the practice of this invention can be achieved in an in situ oil shale retort that is not vertical as in the preferred embodiment. Many formations containing oil shale are essentially horizontal, and vertical retorts are preferred in that situation. When the formation has an appreciable dip, the principal length of the retort can extend at an angle to the vertical. Use of a measuring gas to ascertain the presence of a blockage before beginning the retorting process and retorting only that portion of the fragmented permeable mass not blocked can also be useful in a retort where the direction of gas flow is essentially horizontal. Also, flow of gas through the retort can be upward, where processing gas is introduced at the bottom of the retort and off gas is withdrawn at an intermediate level, or processing gas is introduced at an intermediate level and off gas is withdrawn at the top of the retort. However, it is preferred that the flow of gas through the retort be downward for enhanced yield of liquid hydrocarbons.

Although preferred versions of the invention have been described herein, many modifications and variations are possible. For example, techniques other than described herein for forming the in situ oil shale retort can, of course, be employed. In addition, although the invention has been described in terms of drilling holes to the retort for measuring the pressure of the measuring gas at more than one level of the fragmented mass, one can drill a single hole down into the retort to a single intermediate level or location between the top and bottom end boundaries of the fragmented permeable mass. Then by measuring the pressure of the measuring gas at this intermediate level, it can be determined if the unit pressure drop of the measuring gas is substantially greater in a top portion of the fragmented mass between the top of the fragmented mass and the intermediate level than in a bottom portion of the fragmented mass between the intermediate level and the bottom of the fragmented mass.

As another example of a version of this invention, the entire mass of formation particles in an in situ oil shale retort can be retorted, and only a portion of the mass can be combusted, thereby leaving uncombusted oil shale in the retort. This can be effected by passing hot retorting gas through the entire fragmented mass in the retort and passing oxygen containing gas only through the portion of the fragmented mass not containing a blockage. Thus, it will be understood that this invention can be practiced otherwise than as specifically described.

What is claimed is:

1. The method of recovering oil from oil shale in situ comprising: mining a first tunnel substantially horizontally in a subterranean formation containing oil shale, mining a chamber in the formation extending above the tunnel, blasting formation adjacent the chamber to form a cavity in the formation filled with a fragmented permeable mass of formation particles containing oil shale, igniting oil shale at an intermediate level between the top and the bottom of the cavity, introducing an oxygen containing gas at the intermediate level to sustain combustion of the oil shale and for retorting oil shale between the intermediate level and the bottom of the cavity, thereby leaving uncombusted oil shale in the cavity between the intermediate level and the top of the cavity, and withdrawing gases from the bottom of the cavity.

2. The method of claim 1 further comprising mining a second tunnel into the side of the cavity at said intermediate level, the oxygen containing gas being introduced through said tunnel.

3. A method for recovering values from an in situ oil shale retort in a subterranean formation containing oil shale, the in situ retort containing a fragmented premeable mass of formation particles containing oil shale, the fragmented mass having side boundaries, a first end boundary, and a second end boundary, the method comprising the steps of:

passing a measuring gas through at least a portion of the fragmented mass between the first end boundary of the fragmented mass and the second end boundary of the fragmented mass;

measuring the unit pressure drop of said measuring gas in a first portion of the fragmented mass between the first end boundary of the fragmented mass and an intermediate location, the intermediate location being between the first end boundary and the second end boundary of the fragmented mass, and also measuring the unit pressure drop of said measuring gas in a second portion of the fragmented mass between the intermediate location and the second end boundary of the fragmented mass to determine if the unit pressure drop of said measuring gas is substantially greater in the first portion than in the second portion;

if the unit pressure drop of said measuring gas is substantially greater in the first portion of the fragmented mass than in the second portion of the fragmented mass, introducing a processing gas to the retort at an intermediate location between the first portion of the fragmented mass and the second end boundary of the fragmented mass for processing oil shale in the retort in the second portion of the fragmented mass, thereby leaving unprocessed oil shale in the first portion of the fragmented mass; and withdrawing gas from the retort from the second end boundary of the fragmented mass.

4. The method of claim 4 comprising the additional step of mining a drift into fluid communication with the fragmented mass in the retort at the intermediate location at which a processing gas is introduced to the retort, and wherein the step of introducing a processing gas comprises introducing an oxygen containing gas to the retort through the drift.

5. The method of claim 4 wherein the first end boundary of the fragmented mass is the bottom of the retort and the second end boundary of the fragmented mass is the top of the retort.

6. The method of claim 6 wherein processing gas is introduced to the retort at an intermediate location between the top and the bottom of the retort.

7. The method of claim 6 wherein the first and second end boundaries are spaced apart from each other a greater distance than opposing side boundaries are spaced apart from each other.

8. The method of claim 4 wherein the processing gas contains oxygen.

9. The method of claim 4 wherein the first end boundary of the fragmented mass is the top of the retort and the second end boundary of the fragmented mass is the bottom of the retort.

10. The method of claim 10 wherein processing gas is introduced to the retort at an intermediate location between the top and the bottom of the retort.

11. The method of claim 10 wherein the first and second end boundaries are spaced apart from each other a greater distance than opposing side boundaries are spaced apart from each other.

12. A method for recovering liquid and gaseous products from an in situ oil shale retort in a subterranean formation containing oil shale, the in situ retort containing a fragmented permeable mass of formation particles having side boundaries, a top boundary, and a bottom boundary, the method comprising the steps of:

passing a measuring gas through the fragmented mass between the top boundary of the fragmented mass and the bottom boundary of the fragmented mass;

measuring the unit pressure drop of said measuring gas in an upper portion of the fragmented mass between the top boundary and an intermediate level between the top boundary and the bottom boundary of the fragmented mass, and also measuring the unit pressure drop of the measuring gas in a lower portion of the fragmented mass between the intermediate level and the bottom end boundary of the fragmented mass to determine if the unit pressure drop of said measuring gas is substantially greater in the upper portion of the fragmented mass than in the lower portion of the fragmented mass;

if the unit pressure drop of said measuring gas is substantially greater in the upper portion of the fragmented mass than in the lower portion of the fragmented mass, introducing a processing gas to the retort at the intermediate level for processing oil shale in the retort in the lower portion of the fragmented mass, thereby leaving unprocessed oil shale in the upper portion of the fragmented mass; and withdrawing liquid products and off gas including gaseous products from the retort from the bottom boundary of the fragmented mass.

13. The method of claim 13 comprising the additional step of establishing a combustion zone in the retort at the intermediate level before introducing a processing gas, and wherein the step of introducing a processing gas comprises introducing an oxygen containing gas to the retort at the intermediate level to advance the combustion zone toward the bottom of the retort.

14. In a method of recovering gaseous products from an in situ oil shale retort in a subterranean formation containing oil shale, the in situ retort containing a fragmented permeable mass of particles containing oil shale and having a combustion zone and a retorting zone advancing therethrough, the fragmented mass having side boundaries, a first end boundary, and a second end boundary, wherein the method comprises the steps of:

introducing into the in situ oil shale retort on the trailing side of the combustion zone an oxygen containing gas to advance the combustion zone through the fragmented mass of particles and produce combustion gas in the combustion zone;

passing combustion gas and any unreacted portion of the oxygen containing gas through a retorting zone in the fragmented mass of particles on the advancing side of the combustion zone, wherein oil shale is retorted and gaseous products are produced;

withdrawing a retort off gas comprising said gaseous products, combustion gas and any gaseous unreacted portions of the oxygen containing gas from the in situ oil shale retort from the advancing side of the retorting zone;

the improvement comprising the steps of:

(i) passing a measuring gas through at least a portion of the fragmented mass between the first end boundary of the fragmented mass and the second end boundary of the fragmented mass before introducing the oxygen containing gas into the retort;

(ii) measuring the unit pressure drop of said measuring gas in a first portion of the fragmented mass between the first end boundary of the fragmented mass and an intermediate location, the intermediate location being between the first end boundary and the second end boundary of the fragmented mass, and also measuring the unit pressure drop of said measuring gas in a second portion of the fragmented mass between the intermediate location and the second end boundary of the fragmented mass to determine if the unit pressure drop of said measuring gas is substantially greater in the first portion than in the second portion;

(iii) if the unit pressure drop of said measuring gas is substantially greater in the first portion of the fragmented mass than in the second portion of the fragmented mass, introducing the oxygen containing gas to the retort at an intermediate location between the first portion of the fragmented mass and the second end boundary of the fragmented mass for processing oil shale in the retort in the second portion of the fragmented mass, thereby leaving unprocessed oil shale in the first portion of the fragmented mass; and (iv) withdrawing off gas from the retort from the second end boundary of the fragmented mass.

15. The method of claim 15 comprising the additional step of mining a drift into the retort at the intermediate location at which the oxygen containing gas is introduced to the retort.

16. The method of claim 15 wherein the first end boundary of the fragmented mass is the top of the retort and the second end boundary of the fragmented mass is the bottom of the retort.

* * * * *

UNITED STATES PATENT AND TRADEMARK OFFICE

CERTIFICATE OF CORRECTION

PATENT NO. : 4,119,345

DATED : October 10, 1978

INVENTOR(S) : William J. Bartel; Robert S. Burton, III; Chang Yul Cha

It is certified that error appears in the above-identified patent and that said Letters Patent are hereby corrected as shown below:

| | |
|---|---|
| Column 3, line 5, | "as" should be -- at --. |
| Column 5, line 25, | "shade" should be - shale --; |
| Column 5, line 63, | "valves" should be -- values --. |
| Column 7, line 23, | "premeable" should be -- permeable --; |
| Column 7, line 58, | "The method of claim 4" should be -- The method of claim 3 --; |
| Column 7, line 65, | "The method of claim 4" should be -- The method of claim 3 --. |
| Column 8, line 1, | "The method of claim 6" should be -- The method of claim 5 --; |
| Column 8, line 4, | "The method of claim 6" should be -- The method of claim 5 --; |
| Column 8, line 8, | "The method of claim 4" should be -- The method of claim 3 --; |
| Column 8, line 10, | "The method of claim 4" should be -- The method of claim 3 --; |
| Column 8, line 14, | "The method of claim 10" should be -- The method of claim 9 --; |
| Column 8, line 17, | "The method of claim 10" should be -- The method of claim 9 --; |

UNITED STATES PATENT AND TRADEMARK OFFICE

CERTIFICATE OF CORRECTION

PATENT NO. : 4,119,345

DATED : October 10, 1978

INVENTOR(S) : William J. Bartel; Robert S. Burton, III; Chang Yul Cha

It is certified that error appears in the above-identified patent and that said Letters Patent are hereby corrected as shown below:

Column 8, line 54, "The method of claim 13" should be -- The method of claim 12 --.

Column 10, line 21, "The method of claim 15" should be -- The method of claim 14 --;

Column 10, line 25, "The method of claim 15" should be -- The method of claim 14 --.

Signed and Sealed this

*Sixth* Day of *February 1979*

[SEAL]

*Attest:*

RUTH C. MASON
*Attesting Officer*

DONALD W. BANNER
*Commissioner of Patents and Trademarks*